US006294262B1

(12) United States Patent
Fukuoka

(10) Patent No.: US 6,294,262 B1
(45) Date of Patent: Sep. 25, 2001

(54) COMPOSITION AND PROCESS FOR ANTICORROSIVE TREATMENT OF NON-FERROUS METAL

(75) Inventor: Takayuki Fukuoka, Osaka-fu (JP)

(73) Assignee: Nippon Paint Co., Ltd., Osaka-fu (JP)

( * ) Notice: Subject to any disclaimer, the term of this patent is extended or adjusted under 35 U.S.C. 154(b) by 0 days.

(21) Appl. No.: 09/280,393

(22) Filed: Apr. 5, 1999

(30) Foreign Application Priority Data

Apr. 3, 1998 (JP) ..... 10-091576
Sep. 28, 1998 (JP) ..... 10-273656

(51) Int. Cl.[7] ..... C23C 22/30; B32B 15/04

(52) U.S. Cl. ..... 428/472; 428/702; 148/267; 148/253; 148/258; 148/259; 148/255; 148/254; 106/14.14; 106/14.44; 252/389.5; 252/389.24; 252/389.3; 252/389.53

(58) Field of Search ..... 428/472, 701, 428/702, 472.1; 148/248, 251, 253, 254, 255, 258, 259, 260, 267, 274; 106/14.12, 14.14, 14.44; 252/389.5, 389.23, 389.24, 389.3, 389.53

(56) References Cited

U.S. PATENT DOCUMENTS

| | | | |
|---|---|---|---|
| 3,535,168 | | 10/1970 | Thompson . |
| 4,183,772 | * | 1/1980 | Davis . |
| 4,263,059 | | 4/1981 | Guhde et al. . |
| 4,578,122 | * | 3/1986 | Crotty . |
| 5,147,730 | | 9/1992 | Ogishi et al. . |
| 5,393,354 | | 2/1995 | Bishop . |
| 5,415,702 | | 5/1995 | Bishop et al. . |
| 5,496,652 | * | 3/1996 | Sasaki et al. . |
| 5,624,978 | * | 4/1997 | Soltwedel et al. . |
| 6,071,435 | * | 6/2000 | Komiyama et al. . |
| 6,096,140 | * | 8/2000 | Susa et al. . |

FOREIGN PATENT DOCUMENTS

| | | | |
|---|---|---|---|
| 994062 | | 6/1965 | (GB) . |
| 2 178 065 | | 2/1987 | (GB) . |
| 58084757A | * | 5/1983 | (JP) . |
| 07300683A | * | 11/1995 | (JP) . |
| 411335865A | * | 12/1999 | (JP) . |
| 95/00680 | * | 1/1995 | (WO) . |

* cited by examiner

*Primary Examiner*—Deborah Jones
*Assistant Examiner*—Jennifer McNeil
(74) *Attorney, Agent, or Firm*—Wenderoth, Lind & Ponack, L.L.P.

(57) ABSTRACT

Disclosed is a composition and a process for anticorrosive treatment of the surface of non-ferrous metal. The composition is obtainable by treating an aqueous solution of $CrO_3$ and an inorganic acid with phosphorous acid as a reducing agent until substantially 100% of hexavalent chromium contained in the starting solution is reduced.

20 Claims, No Drawings

COMPOSITION AND PROCESS FOR ANTICORROSIVE TREATMENT OF NON-FERROUS METAL

BACKGROUND OF THE INVENTION

1. Field of the Invention

The present invention provides a composition suitable for primary anticorrosive treatment of the surface of a non-ferrous metal, a process for producing said composition, a process for treating the surface of non-ferrous metal with said composition, and non-ferrous metal of which surface is treated with said composition.

2. Related Arts

The surface of a non-ferrous metal substrate, especially a non-ferrous metal plated steel substrate has a very beautiful appearance and shows a relatively good corrosion-resistance. Therefore, materials having non-ferrous metal surface are widely used for manufacturing, such as, auto mobile parts, electronic appliances, heat exchanger part roof, and the like. Although they show relatively good resistance against corrosion, they still suffered from corrosion problem depending on storage condition. Especially, aluminum containing non-ferrous metal materials tend to be suffered from corrosion problem such as blackening or white rust. In order to avoid such problems, the surface of a non-ferrous metal substrate is generally treated with an anticorrosive composition before being processed into a product. Such treatment has known as anticorrosive primary treatment. A method of typical anticorrosive primary treatment is known as chromate treatment, which comprises a step of coating the surface with a chromate film by applying a chromate anticorrosive treatment composition consisting mainly of chromic acid and water.

A conventional chromate primary treatment may be practiced using an aqueous chromate solution comprising partially reduced chromic acid, that is, an aqueous solution containing both $Cr^{3+}$ and $Cr^{6+}$. Such the conventional chromate anticorrosive treatment composition can be obtained by reducing a part of hexavalent chromium to trivalent chromium with a reducing agent. Preferred reduction ratio may be determined based on other ingredients of the chromate anticorrosive treatment composition, treatment condition, type of the non-ferrous metal substrate to be treated, and the like. Generally, the chromate anticorrosive treatment composition of which reduction ratio, or a degree of $Cr^{6+}$ reduced to $Cr^{3+}$, is from about 30% to about 70% has been used for primary treatment. That is, the typical chromate anticorrosive treatment composition has the $Cr^{6+}/Cr^{3+}$ weight ratio of between 3/7 and 7/3.

The art knows a variety of reducing agents may be employed in reducing hexavalent chromium to trivalent partially, including organic compounds such as starch, saccharides and alcohols, and inorganic compounds such as hydrazine and hypochlorous acid.

Although this type of primary treatment is popular in the art, it is still difficult to control the reduction rate within the preferred range and to keep the ratio for a long time because of the reducing agent remained in the composition. When a chromate anticorrosive treatment composition of which reduction ratio is low, or the weight ratio of $Cr^{3+}/Cr^{6+}$ is low, is used for primary treatment, the obtained chromate coating film will appear yellow. In order to avoid this yellowing problem, the thickness of the chromate film must be very thin and highly uniform. Further, since $Cr^{6+}$ is soluble in water, the obtained chromate coating film easily loses its adhesivity to a secondary paint under a corrosion inducing condition, and therefore, the corrosion resistance ability of the obtained product of which the primary treated surface being coated with the secondary paint becomes poor.

To the contrary, when the reduction ratio of hexavalent chromium in the treatment composition is high, for example, more than 70%, the composition may set to gel with time, and its corrosion resistance becomes poor. Further, the chromate coating film obtained by the conventional method usually appears an interference pattern. That is, the arts in the field acknowledged that if a chromate anticorrosive treatment composition of which reduction ratio of hexavalent chromium is 100% were used, there would be no possibility to obtain a good result.

SUMMARY OF THE INVENTION

One object of the present invention is to provide a process for anticorrosive primary treatment of the surface of a non-ferrous metal substrate which can form a transparent chromate coating film on the surface having a beautiful appearance and an excellent corrosion resistance without problems of yellowing or blackening. Especially, an anticorrosive primary treatment process which allows to provide a chromate coating film with a wide range of thickness. Another object of the present invention is to provide a composition suitable for the anticorrosive primary treatment of the present invention, and a non-ferrous metal substrate, especially a non-ferrous metal plated steel substrate treated by the process of the present invention.

Accordingly, the present invention provides a process for anticorrosive primary treatment of the surface of a non-ferrous metal substrate comprising the steps of: obtaining a chromate anticorrosive treatment composition by a process comprising the steps of;

providing an aqueous solution comprising hexavalent chromium and an inorganic anion; and adding an excess amount of phosphorus acid to the aqueous solution to reduce substantially 100% of the hexavalent chromium contained in the aqueous solution to trivalent; and, treating the surface with the chromate anticorrosive treatment composition to form a chromate coating film on the surface.

According to the present invention, transparent chromate coating film can be formed over the surface of the non-ferrous metal substrate without problems such as interference pattern, blackening and yellowing.

In the present invention, a preferable source of the hexavalent chromium is $CrO_3$. The $CrO_3$ may be contained in the starting aqueous solution in an amount of 7.5–100 g/l calculated as $CrO_3$. The preferred inorganic anion contained in the starting aqueous solution is phosphoric acid. The aqueous solution preferably contains about 10 to 50 parts by weight of phosphate ion calculated as $H_3PO_4$ in relation to 100 parts by weight of hexavalent chromium calculated as $CrO_3$.

According to the present invention, the hexavalent chromium in the starting aqueous solution should be reduced in the presence of inorganic anion by means of phosphorous acid to trivalent chromium. The amount of phosphorous acid used in the present process may be about 150–300 parts by weight per 100 parts by weight of chromium calculated as $CrO_3$.

The reduction of the hexavalent chromium may be carried out according to any conventional manner. For example, the reducing agent, phosphorous acid, may be added to the aqueous solution containing hexavalent chromium and inorganic anion with stirring at ambient temperature. Thus, such treated aqueous solution may be used as a chromate anticorrosive treatment composition of the present invention.

Thus obtained composition may be applied to the surface of the non-ferrous metal substrate, then the substrate may be dried to form a chromate coating film on the surface. By employing the present process, a coating film having a thickness of about 20–200 mg/m$^2$ of chromium can be formed on the surface. Thus, the non-ferrous metal substrate treated according to the present process of which surface is coated with a chromate film having a thickness of about 20–200 mg/m$^2$ of chromium is also within the range of tile present invention.

The chromate anticorrosive treatment composition of the present invention may further comprise a transition metal. The (transition metal)/$CrO_3$ weight ratio in the composition is preferably from about 0.002 to 1.0.

In addition, the chromate anticorrosive treatment composition of the present invention may further comprise a water dispersible organic polymer. The organic polymer may be preferably contained in the composition in an amount of from about 1 to 30 g/l.

DETAILED DESCRIPTION OF THE PREFERRED EMBODIMENTS

According to the present invention, an aqueous solution containing hexavalent chromium and inorganic anion is treated with phosphorous acid whereby substantially 100% of hexavalent chromium in the solution is reduced. The source of hexavalent chromium is not limited but preferably $CrO_3$ and partially reduced $CrO_3$. That is, the chromium contained in the starting aqueous solution may be consisting of either hexavalent chromium alone or a mixture of trivalent and hexavalent chromium when partially reduced chromium is employed. The starting aqueous solution may contain chromium about 7.5–1 g/l, preferably, 50–80 g/l when calculated as $CrO_3$.

The inorganic anion contained in the starting aqueous solution is not limited but preferably selected from the group consisting of phosphate ion, nitrate ion and sulfate ion. Most preferable inorganic anion is phosphate ion. In order to obtain phosphate ion, for example, phosphoric acid or alkaline salt of phosphoric acid may be added to the aqueous solution.

The amount of the inorganic anion contained in the aqueous solution may be stoichiometrically equal to about 10–50 parts by weight, preferably about 20–40 parts by weight of $H_3PO_4$ with respect to 100 parts by weight of chromium calculated as $CrO_3$.

The hexavalent chromium contained in the starting aqueous solution is reduced by means of phosphorous acid. By employing phosphorous acid as a reducing agent, the reduction to trivalent chromium proceeds quickly and the resulting solution becomes stable.

According to the present invention, a stoichiometrically excess phosphorous acid is used for the reduction step. The amount of the acid may be about 150–300 parts by weight relative to 100 parts by weight of chromium calculated as $CrO_3$.

Reduction of hexavalent chromium may be practiced according to any conventional method. For example, phosphorous acid may be added slowly to the starting aqueous solution containing hexavalent chromium and inorganic anion with stirring at ambient temperature.

The amount of hexavalent chromium remained in the solution, or the reduction ratio, may be determined by any conventional method such as standardized methods including spectorophotometoric determination, atomic-absorption spectroscopy and titration. These three standardized methods are described in Japanese Industrial Standard (JIS:1997) K0102 65.2 (the disclosure of English version JIS K0102 65.2 is hereby expressly incorporated by reference). According to the present invention, substantially 100% of hexavalent chromium in the aqueous solution is reduced. According to one embodiment of the present invention, thus obtained solution as above containing completely reduced chromium can be used as chromate anticorrosive treatment composition of the present invention. According to the present process, thus obtained composition may be applied to the surface of a non-ferrous metal substrate to provide a coating film on the surface.

In another embodiment of the present invention, the chromate anticorrosive treatment composition further comprises a transition metal. By adding a transition metal, not only the corrosion resistance ability but also blackening resistance ability of the composition may be improved. Arts in the field knew that to improve both of the corrosion resistance and the blackening resistance of a conventional chromate anticorrosive treatment composition at the same time is difficult, since it has been believed that increase of corrosion resistance of a chromium coating composition causes decrease of the blackening resistance of the composition, and vice versa.

According to this embodiment, the chromate anticorrosive treatment composition may contain a transition metal at an amount to provide a weight ratio of (transition metal)/chromium(calculated as $CrO_3$) being about 0.002–1.0, preferably about 0.005–0.1, and more preferably, about 0.01–0.05.

Any one of transitional metals including Ni, Co, Cu, Zn and a mixture thereof may be employed for the present embodiment. Ni and Co are preferable. The transition metal may be added to the chromate anticorrosive treatment composition either before or after reduction of the hexavalent chromium. The transition metal may be added to the solution in a form of nitrate or sulfate salt.

In a further embodiment of the present invention, the chromate anticorrosive treatment composition of the present invention may contain colloidal silica at an amount of about 10–100, preferably about 40–80 parts by weight calculated as $Si0_2$ relative to 100 parts by weight of chromium calculated as $CrO_3$. If the weight ratio between colloidal silica and chromium calculated as $SiO_2/CrO_3$ is excess than 1, the obtained chromate coating film will appear a white turbidity and, therefore, it is not preferable when transparent chromate coating film is desired.

The colloidal silica employed in this embodiment may be any type of fine silica particles available having an average particle size of about 10–40 $\mu$m including elongate type silica. According to this embodiment, colloidal silica may be added to the composition after completion of the reduction of the hexavalent chromium.

In a further embodiment, the chromate anticorrosive treatment composition of the present invention further comprises a water dispersible organic polymer in order to improve the coating properties of the composition. According to this embodiment, the water dispersible organic polymer may include not only water soluble polymer but also polymers, which can be dispersed in water to provide a stable suspension or emulsion. The examples of the water dispersible polymers include, but not limited to, polyacrylic acid, alkaline metal salt of polyacrylic acid, methyl polyacrylate, polymethacrylate, methylpoly methacrylate and ethyl polyacrylate.

The chromate anticorrosive treatment composition of the present embodiment may contain less than about 30 g/l of the polymer. The organic polymer may be added to the composition after completion of the reduction of the hexavalent chromium.

According to the present process, the chromate anticorrosive treatment composition is applied to the surface of a non-ferrous metal substrate. In the present specification and claims, "non-ferrous metal substrate" includes a substrate made of a non-ferrous metal material and a steel substrate plated with a non-ferrous metal. Examples of non-ferrous metal materials include aluminum, aluminum alloy such as Al—Si, Al—Mg—Si, Zn—Al—Si and Zn—Al—Mg, especially, Zn containing aluminum alloy such as Zn—Al—Si and Zn—Al—Mg, and zinc alloy such as Zn—Ni, Zn—Ni—Cr, Zn—Cr, Zn—Te and Zn—Sn. In addition to above materials, a steel substrate plated with a non-ferrous metal as above by means of, for example, hot-dip coating or electroplating is also preferably treated with the process of the present invention.

According to the present process, any conventional method for primary anticorrosive treatment of the surface of a substrate may be employed. In general, the surface of a non-ferrous metal substrate may be degreased by washing with a conventional degreaser, preferably, a degreaser containing alkaline builder. Then, the degreased substrate may be washed with water and dried before applying the composition of the present invention.

The method for applying the composition on the surface to be treated may be any of conventional methods which may include, but not limited to, applying the composition to the surface by means of roll on system or squeezing roll, and dipping or immersing the substrate in a bath containing the composition.

The composition applied on the surface is then dried to give a chromate coating film. For drying the composition, the substrate may be dried by, for example, heating to provide a substrate temperature of about 50–150° C. to form a chromate film on the surface.

According to the present invention, the preferable amount of chromate deposited on the surface is not limited and may be determined according to the purpose of treatment. By employing the present process, greater than about 100 $mg/m^2$ of chromium can be deposited on the surface of a non-ferrous metal material without causing any problem such as coloring, yellowing or blackening. That is, the present process can increase the thickness of the transparent film deposited on the -surface than the conventional primary treatment, and therefore, the corrosion resistance imparted to the coating film may be much greater than that of conventional chromium primary treating process. The preferred amount of chromium deposited on the surface of the non-ferrous metal is about 20–200 $g/m^2$, more preferably, 20–120 $mg/m^2$.

The present invention will be more clearly understood with reference to the following examples

EXAMPLES

Example 1

Fifty grams per liter (100 parts by weight) of $CrO_3$ was dissolved in water, then 16.8 g/l (33.6 parts by weight) of phosphoric acid was added to the solution. Then, 100 g/l of phosphorous acid was added to this aqueous solution slowly with stirring at ambient temperature and continued to stir until substantially 100% of hexavalent chromium contained is reduced. Hexavalent chromium in the reaction mixture was detected according to JIS K 0102 65.2.1, briefly 1,5-diphenylcarbonohydrazide was added to the reaction mixture and measured the absorbance of produced reddish purple complex to determine hexavalent chromium in the mixture. Sixty minutes later, hexavalent chromium was not detected in the solution, that means substantially 100% of hexavalent chromium contained in the starting aqueous solution was reduced to trivalent. The obtained solution was used as chromate anticorrosive treatment composition of example 1.

Example 2

Thirty two grams per liter (64 parts by weight) of colloidal silica having an average particle size of 10 to 20 m $\mu$ (Snowtex O (trade name); Nissan chemical Industries, Ltd., Tokyo, Japan) was added to the composition of example 1 to provide chromate anticorrosive treatment composition of example 2.

Example 3

An aqueous solution containing 25 g/l of chromium anhydride and 8.4 g/l of phosphoric acid was treated with 50 g/l of phosphorous acid according to the same manner as example 1. It was confirmed that substantially 100% of the starting hexavalent chromium was reduced. Then 16 g/l of elongate type colloidal silica (Snowtex OUP (trade name): Nissan chemical Industries, Ltd., Tokyo, Japan) was added to provide a chromate anticorrosive treatment composition of example 3.

Example 4

An aqueous solution was prepared according to the same manner as example 2 except that the amount of the colloidal silica was 42 g/l. Then, 8.0 g/l of polyacrylic acid was added to the obtained composition to provide a chromate anticorrosive treatment composition of example 4. It was confirmed that substantially 100% of the starting hexavalent chromium was reduced.

Example 5

A chromate anticorrosive treatment composition of example 5 was prepared according to the same manner as example 2 except that the amount of the phosphorous acid was 95 g/l, and 10 g/l of elongate type colloidal silica was used for colloidal silica. It was confirmed that substantially 100% of the hexavalent chromium contained in the starting aqueous solution was reduced.

Example 6

A chromate anticorrosive treatment composition of example 6 was prepared according to the same manner as example 2, except for adding 0.5 g/l of $Ni^{2+}$. The weight ratio of $Ni^{2+}/CrO_3$ was 0.01. It was confirmed that substantially 100% of the hexavalent chromium contained in the starting aqueous solution was reduced.

Example 7

The chromate anticorrosive treatment composition of example 7 was prepared according to the same manner as example 3, except for adding 1.0 g/l of $Ni^{2+}$. The weight ratio of $Ni^{2+}/CrO_3$ was 0.04. It was confirmed that substantially 100% of the hexavalent chromium contained in the starting aqueous solution was reduced.

Example 8

The chromate anticorrosive treatment composition of example 8 was prepared according to the same manner as example 4, except for adding 0.5 g/l of $Ni^{2+}$. The weight ratio of $Ni^{2+}/CrO_3$ was 0.01. It was confirmed that substantially 100% of the hexavalent chromium contained in the starting aqueous solution was reduced.

Comparative example 1

An aqueous solution containing 50 g/l of chromium $CrO_3$ and 8.4 g/l of phosphoric acid were prepared. The starting aqueous solution was treated with 4.8 g/l of formaline as a reducing agent and the chromium acid was reduced until 45% by weight of hexavalent chromium contained in the aqueous solution was reduced, to give the weight ratio of $Cr^{3+}/Cr^{6+}$=4.5/5.5. Ten grams per liter of colloidal silica and 8.4 g/l of polyacrylic acid were added to give a chromate anticorrosive treatment composition of the comparative example 1.

Comparative example 2

The chromate primary treatment composition of comparative example 2 was prepared according to the example 2 except that the amount of the organic polymer is 50 g/l.

Comparative example 3

An aqueous solution containing $Cr(H_{1.5}PO_4)_2$, which provides trivalent chromium at an amount of equivalent to 50 g/l of $CrO_3$, was prepared. Ten grams per liter of colloidal silica and 8.4 g/l of polyacrylic acid were added to give the chromate anticorrosive treatment composition of comparative example 3.

Comparative Example 4

The chromate treatment composition of comparative example 4 was prepared according to the comparative example 1 except that the amount of phosphoric acid is 65 g/l and the reduction ratio of hexavalent chromium is 70%.

Table 1 shows the ingredients of treatment compositions of the examples and comparative examples:

TABLE 1

| | Chromate anticorrosive treatment composition | | | | | | | | | | |
|---|---|---|---|---|---|---|---|---|---|---|---|
| | chromate | | inorganic anion | | | phosphorus acid | colloidal silica | | organic polymer | | transion metal |
| | (g/l) | reduction ratio (%) | | (g/l) | vs.$CrO_3$ | (g/l) | (g/l) | vs.$CrO_3$ | | (g/l) | (g/l) |
| Example | | | | | | | | | | | |
| 1 | 50 | 100 | phosphoric acid | 16.8 | 0.33 | 100 | — | — | — | — | — |
| 2 | 50 | 100 | " | 16.8 | 0.33 | 100 | 32 | 0.64 | — | — | — |
| 3 | 25 | 100 | " | 8.4 | 0.33 | 50 | 16 | 0.64 | — | — | — |
| 4 | 50 | 100 | " | 16.8 | 0.33 | 100 | 42 | 0.84 | poly acrylic acid | 8.0 | — |
| 5 | 50 | 100 | " | 16.8 | 0.33 | 95 | 10 | 0.20 | poly acrylic acid | 8.0 | — |
| 6 | 50 | 100 | " | 16.8 | 0.33 | 100 | 32 | 0.64 | — | — | $Ni^{2+}$ 0.5 |
| 7 | 25 | 100 | " | 8.4 | 0.33 | 50 | 16 | 0.64 | — | — | $Ni^{2+}$ 1.0 |
| 8 | 50 | 100 | " | 16.8 | 0.33 | 100 | 42 | 0.84 | poly acrylic acid | 8.0 | $Ni^{2+}$ 0.5 |
| Comparative example | | | | | | | | | | | |
| 1 | 50 | 45 | " | 8.4 | 0.17 | —* | 10 | 0.20 | poly acrylic acid | 8.0 | — |
| 2 | 50 | 100 | " | 16.8 | 0.33 | 100 | 32 | 0.64 | poly acrylic acid | 50 | — |
| 3 | 50 | — | chromium phosphate | 180 | — | — | 10 | 0.20 | poly acrylic acid | 8.0 | — |
| 4 | 50 | 70 | phosphoric acid | 65 | 1.2 | —* | 10 | 0.20 | poly acrylic acid | 8.0 | — |

*4.8 g/l of folmaline was used

Treatment of the surface of a non-ferrous metal substrate

Zinc-plated steel sheets were immersed in a bath containing an aqueous solution of 2%(w/w) NIPPE SURF-CLEANER 53(trade name) (Nippon Paint Co. Ltd., Osaka, Japan), an alkaline builder containing degreaser and washed for 5 second at 65° C. Then the sheets were washed well with water and dried at a substrate temperature of 60° C. Thus, obtained zinc-plated steel sheets were served for anticorrosive primary treatment using the above prepared compositions. The compositions of examples 1–8 and comparative examples of 1–4 were applied to the sheets respectively by means of draw bar coater so that the respective amount of chromium deposited on the surface was equal to the amount shown in Table 2. Then the sheets were dried in a drier to give substrate temperature of 60° C. to provide chromate coating films on the surface of respective zinc-plated steel sheet. The amount of the chromium deposited on the sheet was determined by spectrofluorimetory.

Evaluation

Appearance, corrosion resistance and blackening resistance of thus obtained primary treated zinc-plated steel sheets were evaluated. Each evaluation was operated as follows;

Appearance:

Appearance of the respective chromate coated sheets was evaluated visually and through b-values determined by means of a differential calorimeter (Suga Shikenki Co. Ltd., Japan). The b-value represents the degree of yellowing. Evaluation was made according to the following criterion:

Visual evaluation:

⊙: not colored

○: slightly white

ΔA: white turbidity

X: colored (yellow and/or interference pattern) b-value (color computer)

⊙: $-3 \leqq b \leqq 3$

○: $-5<b<5$ or $5>b>3$

Δ: $b<-5$ or $5<b$

Corrosion Resistance

A salt spray test was carried out to determine the corrosion resistance. Salt water containing 5 wt % of NaCl at 35° C. was sprayed on the surface of respective sheets at a spraying pressure of 1 kg/cm$^2$. The spraying time were follows:

100±10 mg/m$^2$ of chromium was deposited on the surface: 300 hours

50±10 mg/m$^2$ of chromium was deposited on the surface: 240 hours

25±10 mg/m$^2$ of chromium was deposited on the surface: 150 hours

After the termination of the spraying, the ratio of white rust generated area on the surface (white rust ratio) was determined and evaluated according to the following criterion:

⊙: no white rust

○: less than 5%

Δ: 5%< white rust ratio ≦20%

X: more than 20% of white rust ratio

Blackening resistance

Both of short term and long term blackening resistance were evaluated.

1)Short term blackening resistance

The respective treated sheets were allowed to stand in a wet room of 80° C. ×95% RH for 24 hours. Then, the difference of the lightness (ΔL value) were determined by means of differential calorimeter (Sugai sihkenki Co. Ltd., Japan) and evaluated according to the following criterion:

⊙: $|\Delta L| \leqq 2$

X: $2<|\Delta L|$

2)Long term blackening resistance

The respective treated sheets were allowed to stand in the wet room as above for 11 days and then, the appearance of the sheets were evaluated visually according to the following criterion:

⊙: no blackening

○: slightly blackened

X: blackened

The results are shown in Table 2.

TABLE 2

| | treated substrate | Cr deposited ($mg/m^2$) | evaluation: appearance visual | appearance b-value | corrosion resistance | blackening resistance short-term | blackening resistance long-term |
|---|---|---|---|---|---|---|---|
| Example | | | | | | | |
| 1 | zinc-plated steel sheet | 102 | ⊙ | ⊙ | ○ | ⊙ | X |
| 2 | " | 100 | ⊙ | ⊙ | ⊙ | ⊙ | X |
| 3 | " | 52 | ○ | ⊙ | ⊙ | ⊙ | X |
| 4 | " | 94 | ⊙ | ⊙ | ⊙ | ⊙ | X |
| | " | 20 | ⊙ | ⊙ | ○ | ⊙ | X |
| 5 | " | 98 | ⊙ | ⊙ | ○ | ⊙ | |
| 6 | " | 85 | ⊙ | ⊙ | ⊙ | — | ⊙ |
| 7 | " | 52 | ⊙ | ⊙ | ⊙ | — | ⊙ |
| 8 | " | 70 | ⊙ | ⊙ | ⊙ | — | ⊙ |
| Comparative example | | | | | | | |
| 1 | " | 20 | Δ | ○ | Δ | ⊙ | X |
| | " | 50 | X | X | ○ | ⊙ | X |
| | " | 100 | X | X | ○ | X | X |
| 2 | " | 50 | ⊙ | ⊙ | Δ | X | X |
| 3 | " | 50 | ⊙ | ⊙ | X | X | X |
| | " | 100 | ⊙ | ○ | Δ | X | X |
| 4 | " | 52 | ○ | ○ | X | ⊙ | X |

What is claimed is:

1. A process for treatment of a surface of a non-ferrous metal substrate comprising the step of:

treating said surface with a chromate anticorrosive treatment composition prepared by a process comprising the steps of;

providing an aqueous solution comprising hexavalent chromium and inorganic anion; and adding an excess amount of phosphorus acid to the aqueous solution to reduce substantially 100% of the hexavalent chromium contained in the aqueous solution to trivalent chromium;

to thereby form a transparent coating film on said surface.

2. The process according to claim 1, wherein the aqueous solution comprises 100 parts by weight of $CrO_3$ and about 10–50 parts by weight of phosphoric acid, and the amount of phosphorous acid is about 150–300 parts by weight.

3. The process according to claim 1, wherein the amount of chromium contained in the aqueous solution is about 7.5–100 g/l.

4. The process according to claim 1, wherein the chromate anticorrosive treatment composition further comprises a transition metal in an amount of providing the (transition metal)/$CrO_3$ weight ratio of about 0.002–1.0.

5. The process according to claim 4, wherein the transition metal is nickel or cobalt.

6. The process according to claim 1, wherein the chromate anticorrosive treatment composition further comprises colloidal silica in an amount of providing the $SiO_2/CrO_3$ weight ratio of about 0.1–1.0.

7. The process according to claim 1, wherein the chromate anticorrosive treatment composition further comprises about 1–30 g/l of a water soluble organic polymer.

8. The process according to claim 1, wherein the non-ferrous metal substrate is a steel substrate plated with a non-ferrous metal.

9. The process according to claim 1, further comprising the steps of:

degreasing and washing the surface to be treated;

applying the chromate anticorrosive treatment composition on the surface; and drying the substrate.

10. The process according to claim 1, wherein the chromate coating film formed on the surface contains about 20–200 $mg/m^2$ of chromium.

11. A non-ferrous metal substrate treated according to claim 1, wherein about 20–200 $mg/m^2$ of chromium is deposited on the surface of the substrate.

12. A process for preparing a chromate anticorrosive treatment composition which forms a transparent coating comprising the steps of;

providing an aqueous solution comprising hexavalent chromium and inorganic anion; and adding an excess amount of phosphorus acid to the aqueous solution to reduce substantially 100% of the hexavalent chromium contained in the aqueous solution to trivalent chromium.

13. The process according to claim 12, wherein the aqueous solution comprises 100 parts by weight of $CrO_3$ and about 10–50 parts by weight of phosphoric acid, and the amount of phosphorous acid is about 150–300 parts by weight.

14. The process according to claim 12, wherein the amount of chromium contained in the aqueous solution is about 7.5–100 g/l.

15. The process according to claim 12, wherein the chromate anticorrosive treatment composition further comprises a transition metal in an amount of providing the (transition metal)/$CrO_3$ weight ratio of about 0.002–1.0.

16. The process according to claim 15, wherein the transition metal is nickel or cobalt.

17. The process according to claim 12, wherein the chromate anticorrosive treatment composition further comprises colloidal silica in an amount of providing the $SiO_2$/$CrO_3$ weight ratio of about 0.1–1.0.

18. The process according to claim 12, wherein the chromate anticorrosive treatment composition further comprises about 1–30 g/l of a water soluble organic polymer.

19. A chromate anticorrosive treatment composition which is prepared by a process comprising the steps of;

providing an aqueous solution comprising hexavalent chromium and inorganic anion; and adding an excess amount of phosphorus acid to the aqueous solution to reduce substantially 100% of the hexavalent chromium contained in the aqueous solution to trivalent chromium.

20. A method for forming a transparent coating on a surface of a non-ferrous metal substrate comprising the step of:

treating said surface with a chromate anticorrosive treatment composition prepared by a process comprising the steps of;

providing an aqueous solution comprising hexavalent chromium and inorganic anion; and adding an excess amount of phosphorus acid to the aqueous solution to reduce substantially 100% of the hexavalent chromium contained in the aqueous solution to trivalent chromium;

to thereby form the transparent coating film on said surface.

* * * * *